US009814947B1

(12) United States Patent
Seluga et al.

(10) Patent No.: US 9,814,947 B1
(45) **Date of Patent: *Nov. 14, 2017**

(54) GOLF CLUB HEAD HAVING COMPOSITE TUBES

(71) Applicant: Callaway Golf Company, Carlsbad, CA (US)

(72) Inventors: James A. Seluga, Carlsbad, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/794,578

(22) Filed: Jul. 8, 2015

Related U.S. Application Data

(63) Continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/684,079, filed on Aug. 16, 2012, provisional application No. 61/665,203, filed on Jun. 27, 2012.

(51) Int. Cl.
*A63B 53/06* (2015.01)
*A63B 53/04* (2015.01)

(52) U.S. Cl.
CPC .. *A63B 53/0466* (2013.01); *A63B 2053/0412* (2013.01)

(58) Field of Classification Search
CPC .. A63B 53/04; A63B 53/06; A63B 2053/0791
USPC ..... 473/324, 329, 330, 334, 340, 342
See application file for complete search history.

(56) References Cited

U.S. PATENT DOCUMENTS 1,133,129 A * 3/1915 Govan ..... A63B 53/047 473/337
3,652,094 A * 3/1972 Glover ..... A63B 53/08 473/337

(Continued)

FOREIGN PATENT DOCUMENTS

| | | |
|---|---|---|
| JP | 01043278 | 2/1989 |
| JP | 3821516 | 9/2006 |
| JP | 2007267777 | 10/2007 |

OTHER PUBLICATIONS

Non-Final Office Action dated Apr. 20, 2017, U.S. Appl. No. 15/279,188.

(Continued)

*Primary Examiner* — William Pierce
(74) *Attorney, Agent, or Firm* — Michael A. Catania; Rebecca Hanovice; Sonia Lari

(57) ABSTRACT

A golf club head comprising a body and a plurality of carbon tubes is disclosed herein. The body comprises a face section, a sole section with a protrusion extending upward and a crown section. The body defines a hollow interior. Each of the plurality of carbon tubes extends from the crown section to the protrusion of the sole section.

15 Claims, 6 Drawing Sheets

(56) References Cited

U.S. PATENT DOCUMENTS 4,461,479 A * 7/1984 Mitchell ..... A63B 60/24 473/292
4,795,159 A * 1/1989 Nagamoto ..... A63B 53/04 473/338
4,883,274 A * 11/1989 Hsien ..... A63B 53/04 473/335
5,082,278 A * 1/1992 Hsien ..... A63B 53/04 473/242
5,152,527 A * 10/1992 Mather ..... A63B 60/24 473/291
5,273,283 A * 12/1993 Bowland ..... A63B 53/04 473/338
5,299,807 A * 4/1994 Hutin ..... A63B 53/04 473/329
5,582,553 A * 12/1996 Ashcraft ..... A63B 53/04 473/338
5,586,947 A * 12/1996 Hutin ..... A63B 53/04 473/324
5,692,967 A * 12/1997 Guyer ..... A63B 69/3661 473/262
5,766,094 A 6/1998 Mahaffey et al.
6,033,318 A * 3/2000 Drajan, Jr. ..... A63B 53/02 473/309
6,299,547 B1 10/2001 Kosmatka
6,332,847 B2 12/2001 Murphy et al.
6,368,231 B1 * 4/2002 Chen ..... A63B 53/04 473/329
6,383,090 B1 5/2002 O'Doherty et al.
6,413,168 B1 * 7/2002 McKendry ..... A63C 11/221 280/823
6,435,978 B1 8/2002 Galloway et al.
6,475,100 B1 11/2002 Helmstetter et al.
6,506,128 B1 * 1/2003 Bloom, Jr. ..... A63B 53/007 473/292
6,524,197 B2 2/2003 Boone
6,835,145 B2 12/2004 Tsurumaki
6,852,038 B2 2/2005 Yabu
6,979,270 B1 12/2005 Allen
7,066,835 B2 6/2006 Evans et al.
7,166,041 B2 1/2007 Evans
7,387,579 B2 6/2008 Lin et al.
7,445,563 B1 11/2008 Werner
7,744,484 B1 * 6/2010 Chao ..... A63B 53/0466 473/324
7,824,277 B2 * 11/2010 Bennett ..... A63B 53/0466 473/328
7,914,393 B2 * 3/2011 Hirsch ..... A63B 53/0466 473/332
8,197,357 B1 * 6/2012 Rice ..... A63B 53/0466 473/334
8,257,195 B1 * 9/2012 Erickson ..... A63B 53/0466 473/329
8,403,771 B1 * 3/2013 Rice ..... A63B 53/04 473/328
8,419,564 B1 * 4/2013 Solheim ..... A63B 53/08 403/290
8,523,702 B2 9/2013 Thomas et al.
8,540,587 B2 9/2013 Hirsch et al.
8,591,352 B2 * 11/2013 Hirano ..... A63B 53/0466 473/336
8,608,585 B2 12/2013 Stites et al.
8,663,027 B2 3/2014 Morales et al.
8,834,293 B2 9/2014 Thomas et al.
8,834,294 B1 * 9/2014 Seluga ..... A63B 53/04 473/338
8,911,301 B1 * 12/2014 Allen ..... A63B 53/047 473/329
8,956,244 B1 * 2/2015 Westrum ..... A63B 53/06 473/338
8,986,133 B2 * 3/2015 Bennett ..... A63B 59/0092 473/329
9,067,110 B1 * 6/2015 Seluga ..... A63B 53/06
9,079,078 B2 7/2015 Greensmith et al.
9,180,349 B1 * 11/2015 Seluga ..... A63B 53/04
9,216,332 B1 * 12/2015 Ehlers ..... A63B 53/06
2002/0137576 A1 * 9/2002 Dammen ..... A63B 53/04 473/336
2010/0331101 A1 12/2010 Sato et al.
2012/0071258 A1 * 3/2012 Yamaguchi ..... A63B 53/00 473/287
2013/0165252 A1 * 6/2013 Rice ..... A63B 53/04 473/329
2013/0165254 A1 * 6/2013 Rice ..... A63B 53/0466 473/329
2013/0184099 A1 * 7/2013 Stites ..... A63B 53/06 473/338
2013/0244808 A1 * 9/2013 Bennett ..... A63B 53/06 473/335
2015/0094166 A1 * 4/2015 Taylor ..... A63B 53/06 473/335
2015/0165280 A1 6/2015 Hebreo

OTHER PUBLICATIONS

Non-Final Office Action dated Feb. 23, 2017, U.S. Appl. No. 15/385,549.
Final Office Action dated Feb. 21, 2017, U.S. Appl. No. 14/997,199.
Final Office Action dated Mar. 24, 2017, U.S. Appl. No. 15/063,107.
Non-Final Office Action dated Jun. 28, 2016, U.S. Appl. No. 15/013,052.
Non-Final Office Action dated Apr. 17, 2017, U.S. Appl. No. 15/446,754.
Non-Final Office Action dated Apr. 17, 2017, U.S. Appl. No. 15/447,638.
Non-Final Office Action dated Dec. 1, 2016, U.S. Appl. No. 15/005,875.
Non-Final Office Action dated Jun. 28, 2016, U.S. Appl. No. 15/011,313.
Non-Final Office Action dated Jul. 12, 2016, U.S. Appl. No. 14/997,199.
Non-Final Office Action dated Jul. 11, 2016, U.S. Appl. No. 15/063,107.
Non-Final Office Action dated Jul. 22, 2016, U.S. Appl. No. 15/051,361.
Non-Final Office Action dated Sep. 8, 2016, U.S. Appl. No. 14/847,227.

* cited by examiner

GOLF CLUB HEAD HAVING COMPOSITE TUBES

CROSS REFERENCES TO RELATED APPLICATIONS

The present invention is a continuation-in-part of U.S. patent application Ser. No. 14/755,068, filed on Jun. 30, 2015, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which claims priority to U.S. Provisional Patent Application No. 61/898,956, filed on Nov. 1, 2013, and which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with composite tubes.

Description of the Related Art

The prior art discloses various golf club heads having interior structures.

Yabu, U.S. Pat. No. 6,852,038 for a Golf Club Head And Method OF Making The Same, discloses a golf club head with a sound bar.

Galloway, U.S. Pat. No. 7,118,493 for a Multiple Material Golf Club Head discloses a golf club head with a composite aft body having an interior sound component extending upward from a sole section of a metal face component.

Seluga et al., U.S. Pat. No. 8,834,294 for a Golf Club Head With Center Of Gravity Adjustability discloses a golf club head with a tube having a mass for adjusting the CG of a golf club head.

Dawson et al., U.S. Pat. No. 8,900,070 for a Weighted Golf Club Head discloses a golf club head with an interior weight lip extending from the sole towards the face.

However, the prior art fails to disclose an interior structure that increases ball speed through reducing stress in the face at impact, with a minimal increase in mass to the golf club head.

BRIEF SUMMARY OF THE INVENTION

The golf club head comprises interior carbon tubes to reduce the stress in a face during impact with a golf ball.

One aspect of the present invention is a golf club head with carbon tubes. The golf club head includes a body, a face component and carbon tubes. The body comprises a sole section, a crown section, a front section having an opening, and a protrusion extending upward from the sole section and towards the front section. The face component is positioned over the opening. Each of the carbon tubes extends from the crown section to the protrusion.

Another aspect of the present invention is a fairway wood-type golf club head comprising a body, a face component and carbon tubes. The body comprises a sole section having a protrusion extending upward and forward, a crown section and a front section having an opening. The body is composed of a first metal material. The face component is positioned over the opening. The face component is composed of a second metal material. The face component comprises a striking plate portion and a return portion. Each of the carbon tubes extends from the crown section to the protrusion.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
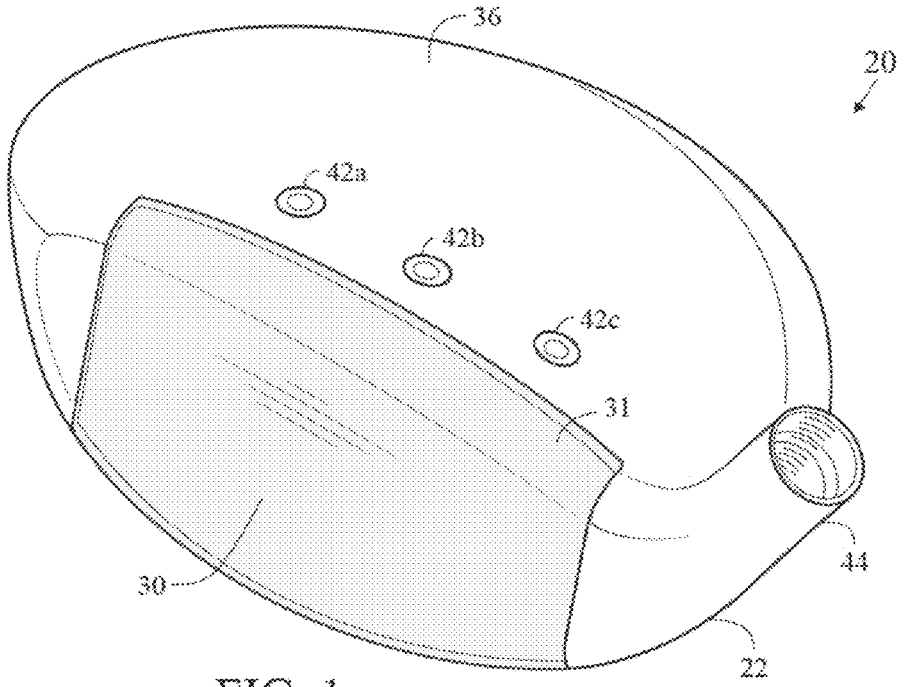
FIG. 1 is a top perspective view of a golf club head of the present invention.
Figure 2:
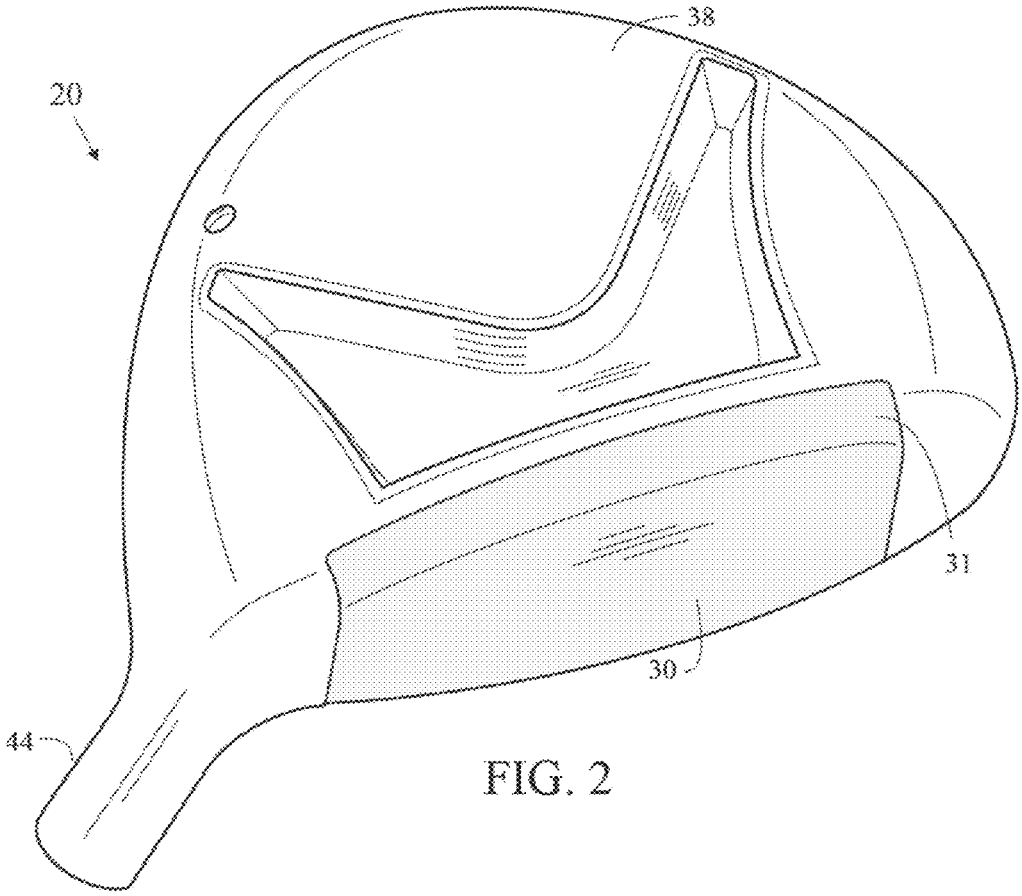
FIG. 2 is a sole perspective view of the golf club head shown in FIG. 1.
Figure 3:
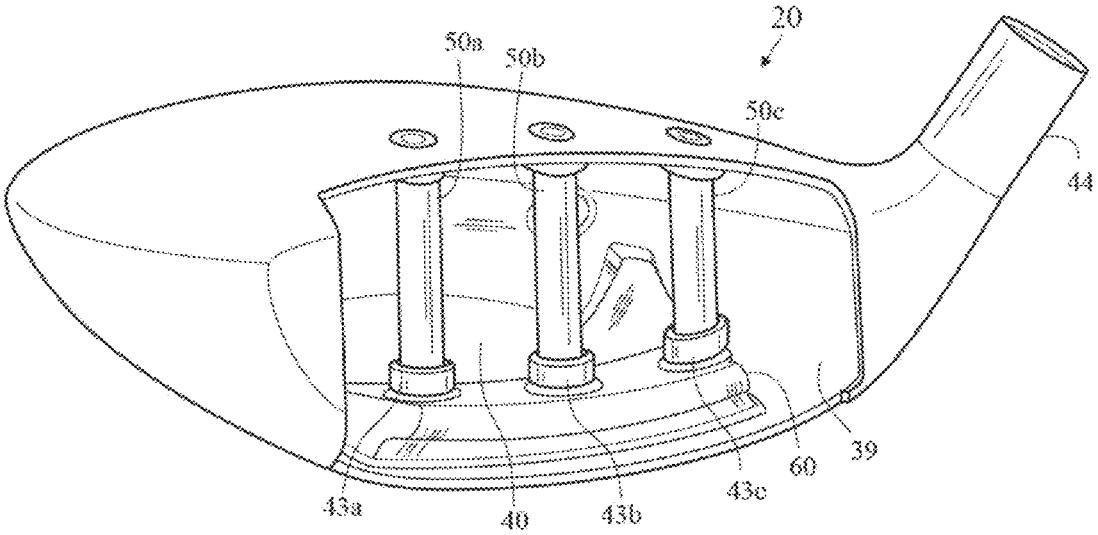
FIG. 3 is a front perspective view of the golf club head shown in FIG. 1 with a front section removed to illustrate an interior.
Figure 4:
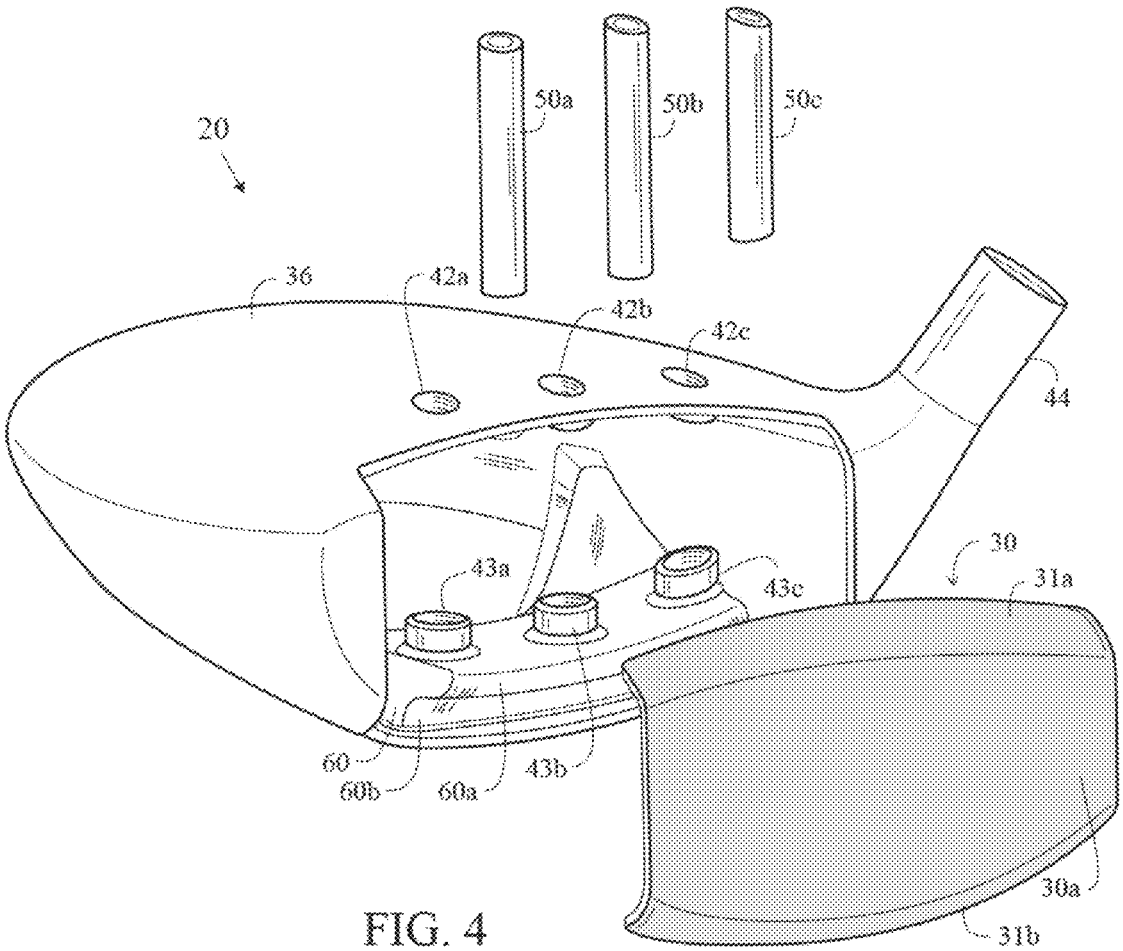
FIG. 4 is an exploded view of the golf club head shown in FIG. 1.
Figure 5:
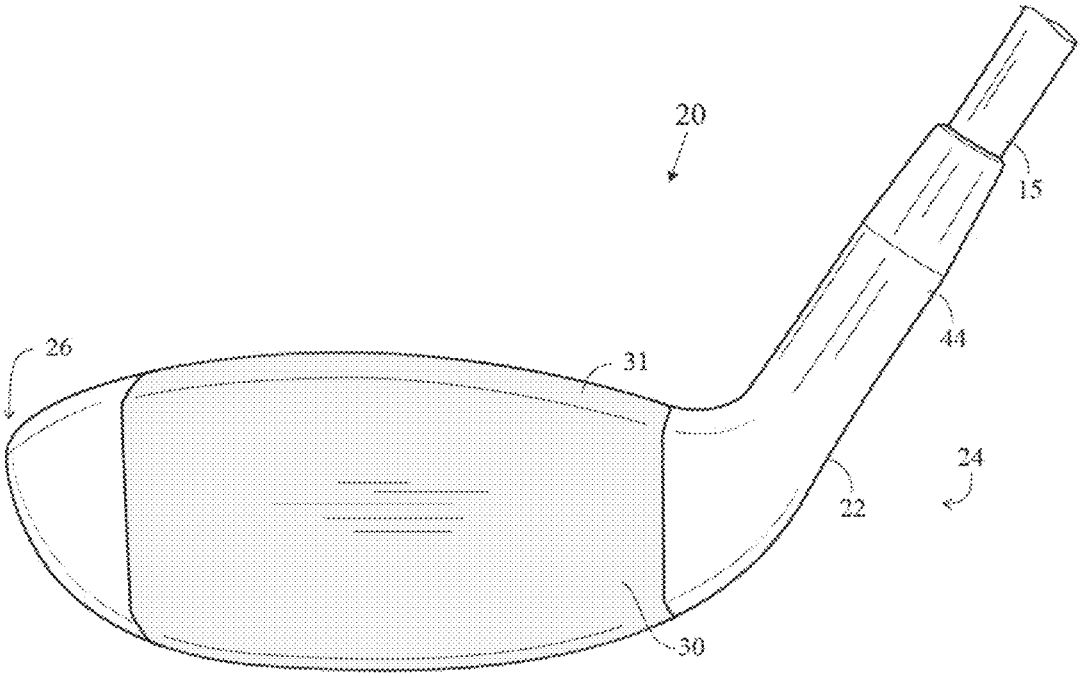
FIG. 5 is a front elevational view of the golf club head shown in FIG. 1.
Figure 6:
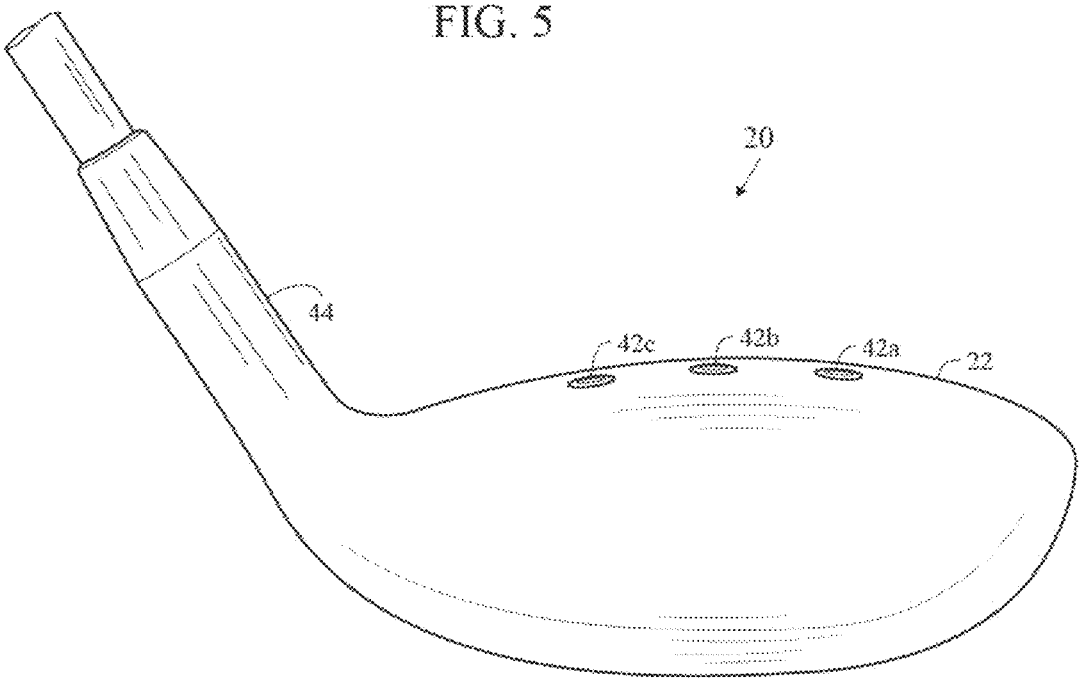
FIG. 6 is a rear elevational view of the golf club head shown in FIG. 1.
Figure 7:
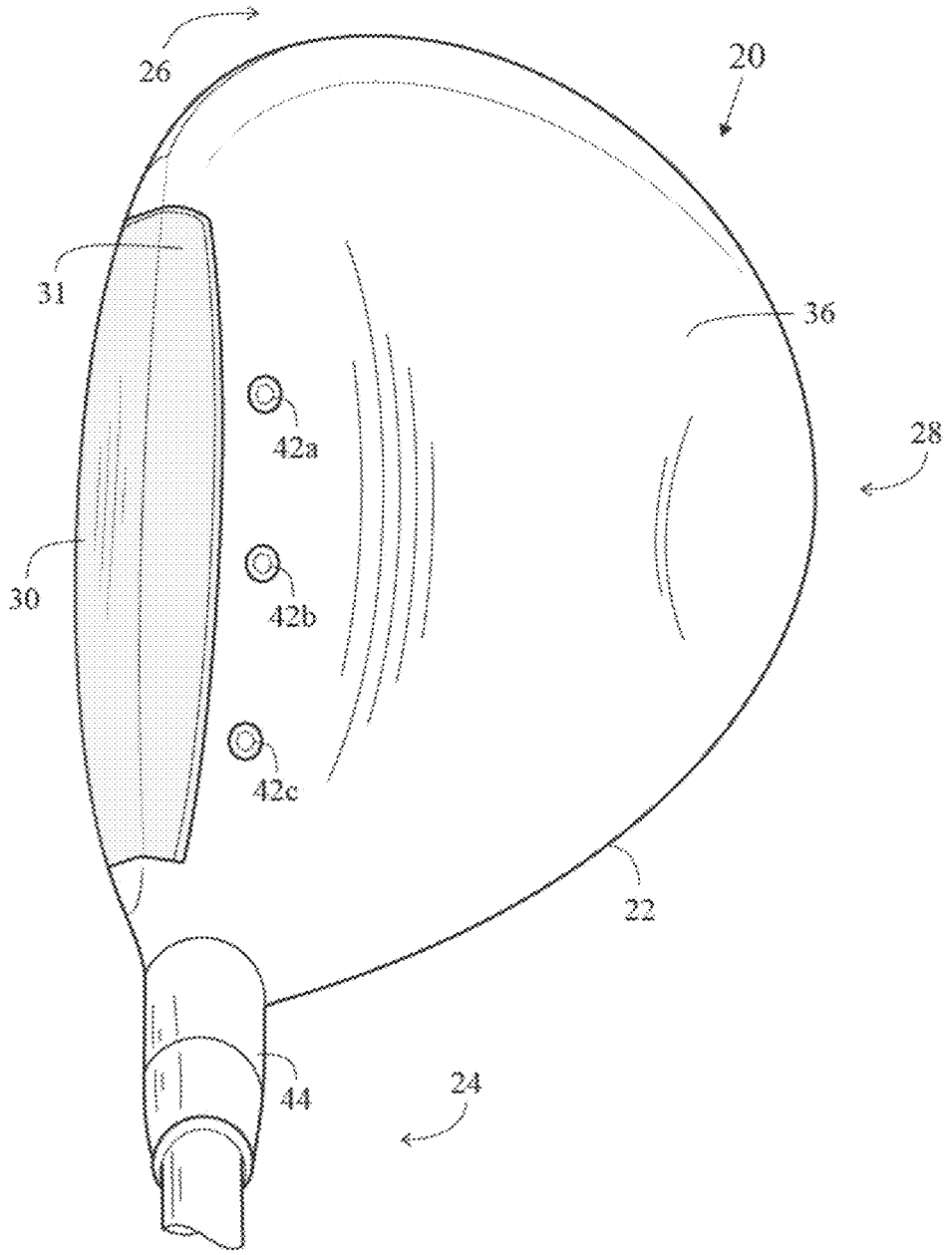
FIG. 7 is a top plan view of the golf club head shown in FIG. 1.
Figure 8:
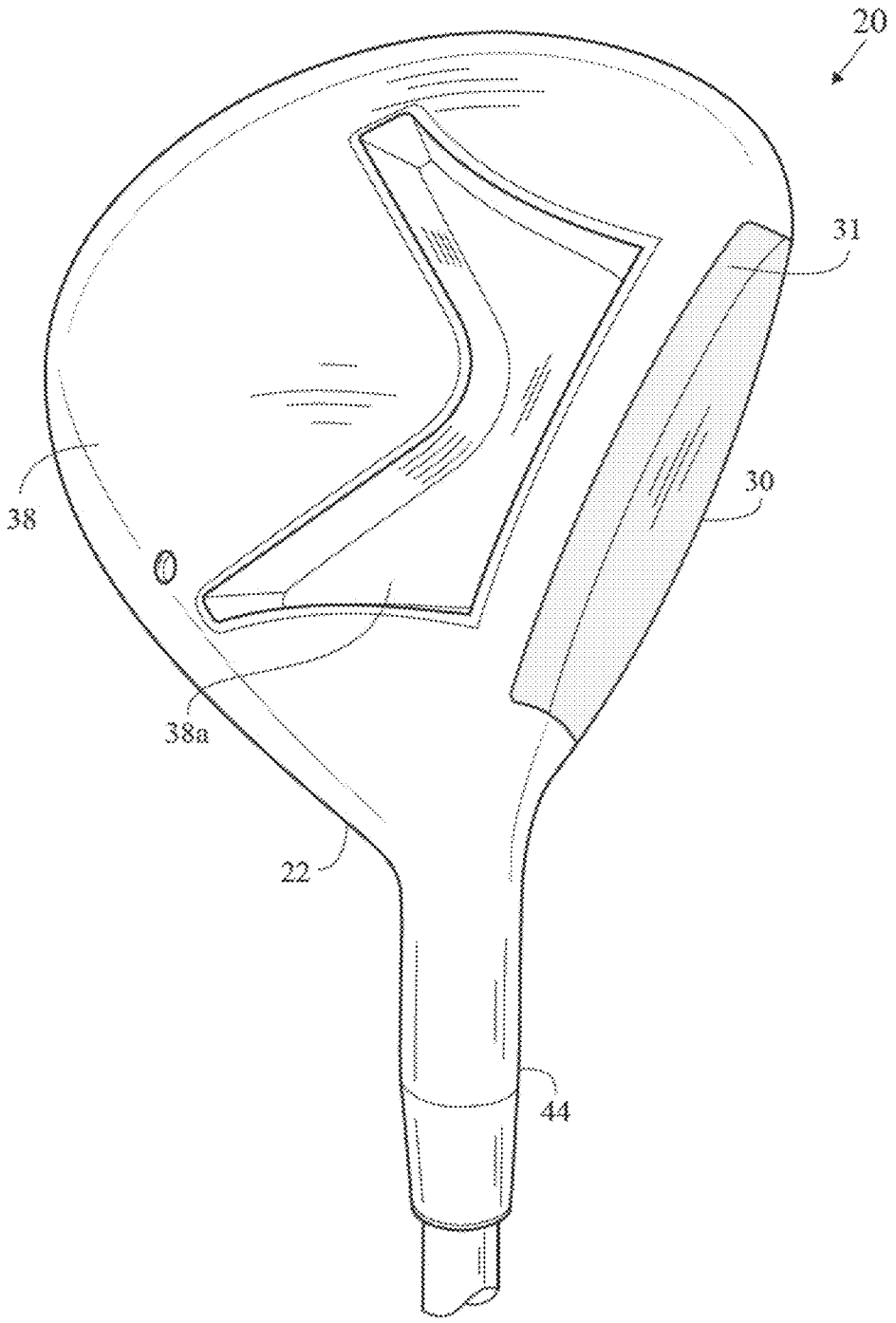
FIG. 8 is a bottom plan view of the golf club head shown in FIG. 1.
Figure 9:
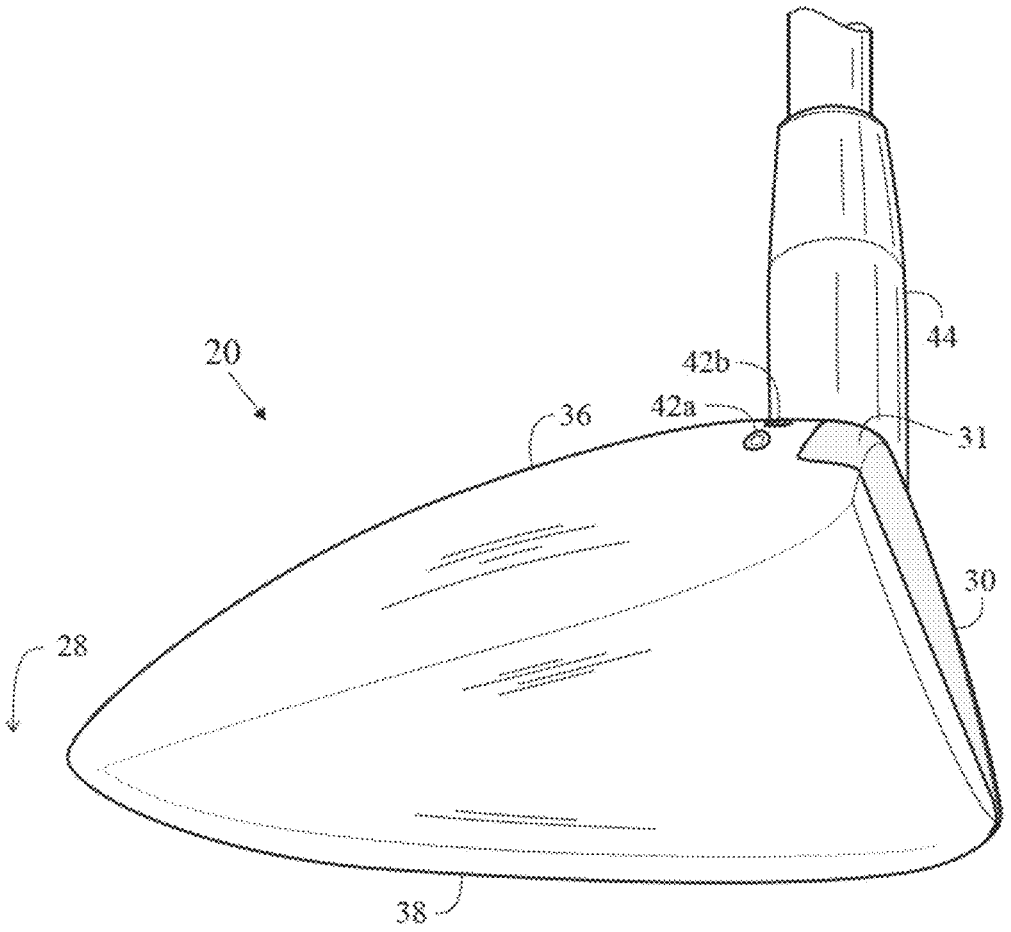
FIG. 9 is a side elevational view of the golf club head shown in FIG. 1.

As shown in FIGS. 1-4, a golf club head is generally designated 20. The golf club head 20 preferably includes a body 22 having a crown section 36, a sole section 38 with a protrusion 60, a heel end 24, a toe end 26 and an aft end 28. A face component 30 is placed over an opening 39 in the body 22. The body section 22, along with the face component 30, preferably defines a hollow interior 40. Within the hollow interior, multiple carbon tubes 50 extend from the protrusion 60 of the sole section 38 upward to the crown section 36.

The plurality of carbon tubes 50 preferably ranges from two carbon tubes to eight carbon tubes. Each of the plurality of carbon tubes 50 preferably has a diameter ranging from 2 millimeters to 5 millimeters. Each of the plurality of carbon tubes 50 preferably has a length ranging from 30 millimeters to 60 millimeters. Each of the plurality of carbon tubes 50 is preferably positioned within 11 millimeters of an interior surface of the face section 30. The mass of each of the plurality of carbon tubes 50 preferably ranges from 0.5 gram to 3 grams, more preferably from 1 gram to 2 grams, and most preferably each carbon tube 50 has a mass of 1.5 grams.

The crown section 36 preferably comprises a plurality of apertures 42. Each of the plurality of apertures 42 preferably corresponds to a carbon tube 50 of the plurality carbon tubes 50. The sole section 38 preferably comprises a plurality of bosses 43. Each of the plurality of bosses 43 preferably corresponds to a carbon tube 50 of the plurality carbon tubes 50. The carbon tubes 50 are preferably glued into the bosses 50.

The face component 30 preferably comprises a striking plate section 30*a* and return sections 31*a* and 31*b* that are substantially perpendicular to the striking plate section 30*a*. The face component 30 is preferably welded over the opening 39 of the body 22. The face component 30 is preferably composed of a metal that is different than the metal of the body 22. The face component 30 is preferably composed of a high performance metal material such as SP700 titanium alloy, carpenter steel, or the like. The face component 30 preferably has a varying thickness. In a preferred embodiment, the face component 30 has a varying thickness such as described in U.S. Pat. No. 7,448,960, for a Golf Club Head With Variable Face Thickness, which pertinent parts are hereby incorporated by reference. Other alternative embodiments of the thickness of the face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the face section has a uniform thickness.

The body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 22 is composed of 17-4 steel alloy. Additional methods for manufacturing the body 22 include forming the body 22 from a flat sheet of metal, super-plastic forming the body from a flat sheet of metal, machining the body 22 from a solid block of metal, electrochemical milling the body 22 from a forged pre-form, casting the body using centrifugal casting, casting the body 22 using levitation casting, and like manufacturing methods.

The golf club head 20, when designed as a driver, preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. The volume of the golf club head 20 will also vary between fairway woods (preferably ranging from 3-woods to eleven woods) with smaller volumes than drivers.

The golf club head 20, when designed as a driver, preferably has a mass no more than 215 grams, and most preferably a mass of 180 to 215 grams. When the golf club head 20 is designed as a fairway wood, the golf club head preferably has a mass of 135 grams to 200 grams, and preferably from 140 grams to 165 grams.

A preferred embodiment of the golf club head 20 has a volume of 460 cubic centimeters with the Characteristic Time (CT) of the face close to, but not exceeding 257 microsecond ("μS") limit set by the USGA.

In order to achieve a low, frontward CG without affecting a weld seam, the protrusion 60 is located inside the hollow interior 40 and proximate the opening 39. This construction avoids creating welding problems, but still allows for discretionary mass to be located mostly low and forward in the golf club head 20.

The protrusion 60 preferably has a base section 60*b* and an extension section 60*a*. The composite tubes 50 are positioned on the extension section 60*b* of the protrusion 60.

The protrusion 60, which preferably is cast into the body 22 but may, in alternative embodiments, be welded or affixed mechanically to the body 22, extends upwards from the sole section 38 and protrudes from the opening of the body 22. When the golf club head 20 is assembled, the protrusion 60 extends towards the face component 30 without making contact with the striking face 30*a*. The protrusion 60 preferably comprises at least 20% of the mass of the body 22, and more preferably 30% of the mass of the body 22. The protrusion 60 preferably ranges in mass from 30 grams to 60 grams.

Erickson, U.S. Pat. No. 8,414,420 for a Weighted Golf Club Head is hereby incorporated by reference in its entirety.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a body comprising a sole section, a crown section, a front section having an opening, and an elongated protrusion extending upward from the sole section and towards the front section and extending from a heel side of the body to a toe side of the body;

a face component positioned over the opening, the face component comprising a striking plate; and a plurality of carbon tubes, wherein the plurality of carbon tubes ranges from two carbon tubes to eight carbon tubes, wherein each of the plurality of carbon tubes is disposed within a hollow interior of the body and extends from the crown section to the elongated protrusion, wherein the crown section comprises a plurality of crown apertures, each of the plurality of crown apertures corresponding to a carbon tube of the plurality carbon tubes, wherein the elongated protrusion of the sole section comprises a plurality of bosses, each of the plurality of bosses corresponding to a carbon tube of the plurality carbon tubes, wherein each of the plurality of bosses extends upwards from an upper surface of the elongated protrusion, and wherein each of the plurality of carbon tubes is located within 11 millimeters of an interior surface of the striking plate.

2. The golf club head according to claim 1, wherein each of the plurality of carbon tubes has a diameter ranging from 2 millimeters to 5 millimeters.

3. The golf club head according to claim 1, wherein each of the plurality of carbon tubes has a length ranging from 30 millimeters to 60 millimeters.

4. The golf club head according to claim 1, wherein the golf club head has a volume ranging from 100 cubic centimeters to 300 cubic centimeters.

5. The golf club head according to claim 1, wherein each of the plurality of carbon tubes is positioned rearward from the interior surface a distance ranging from 2 millimeters to 11 millimeters.

6. The golf club head according to claim 1, wherein the body is composed of an iron alloy.

7. A fairway wood-type golf club head comprising:

a body comprising a crown section, a front section having an opening, and a sole section having an elongated protrusion extending from a heel side of the body to a toe side of the body and upward and forward towards the front section, the body composed of a first metal material;

a face component composed of a second metal material positioned over the opening, the face component comprising a striking plate portion and a return portion that extends substantially perpendicular to the striking plate portion; and a plurality of carbon tubes, each of the plurality of carbon tubes disposed within a hollow interior of the body and extending from the crown section to the elongated protrusion, wherein the plurality of carbon tubes ranges from two carbon tubes to eight carbon tubes, wherein each of the plurality of carbon tubes is located within 11 millimeters of an interior surface of the striking plate portion, wherein the crown section comprises a plurality of crown apertures, each of the plurality of crown apertures corresponding to a carbon tube of the plurality carbon tubes, wherein the first metal material is different from the second metal material, wherein the elongated protrusion of the sole section comprises a plurality of bosses, wherein each of the plurality of bosses extends from an upper surface of the elongated protrusion, and wherein each of the plurality of bosses corresponds to a carbon tube of the plurality carbon tubes.

8. The fairway wood-type golf club head according to claim 7, wherein the elongated protrusion comprises a base section and an extension section, and wherein the extension section extends above an internal surface of the sole section and toward the striking plate portion.

9. The fairway wood-type golf club head according to claim 7, wherein each of the plurality of carbon tubes has a diameter ranging from 2 millimeters to 5 millimeters.

10. The fairway wood-type golf club head according to claim 7, wherein each of the plurality of carbon tubes has a length ranging from 30 millimeters to 60 millimeters.

11. The fairway wood-type golf club head according to claim 7, wherein the golf club head has a volume ranging from 100 cubic centimeters to 300 cubic centimeters.

12. The fairway wood-type golf club head according to claim 7, wherein each of the plurality of carbon tubes is positioned rearward from an interior surface of the striking plate portion a distance ranging from 2 millimeters to 11 millimeters.

13. The fairway wood-type golf club head according to claim 7, wherein the body is composed of a titanium alloy.

14. The fairway wood-type golf club head according to claim 7, wherein the body is composed of an iron alloy.

15. A golf club head comprising:

a body comprising a sole section, a crown section having a plurality of crown of apertures, a hollow interior, a front section having an opening in communication with the hollow interior, and an elongated protrusion extending from a heel side of the body to a toe side of the body within the hollow interior, the elongated protrusion extending upward from the sole section towards the front section;

a face component positioned over the opening, the face component comprising a striking plate portion and a return portion extending substantially perpendicular to the striking plate portion; and a plurality of carbon tubes, wherein the elongated protrusion comprises a base section and an extension section, wherein the extension section extends above an internal surface of the sole section and toward the striking plate portion without making contact with the striking plate portion, wherein each of the plurality of carbon tubes is disposed within the hollow interior and extends from the crown section to connect with the extension section of the elongated protrusion, wherein the elongated protrusion comprises at least 20% of an overall mass of the body, wherein the golf club head has a volume ranging from 100 cubic centimeters to 300 cubic centimeters and a mass ranging from 135 grams to 200 grams, wherein the face component is welded to the body, wherein the plurality of carbon tubes ranges from two carbon tubes to eight carbon tubes, wherein each of the plurality of carbon tubes is positioned rearward from an interior surface of the striking face portion a distance ranging from 2 millimeters to 11 millimeters, and wherein each of the plurality of crown apertures corresponds to a carbon tube of the plurality carbon tubes.

* * * * *